US007697889B2

(12) United States Patent
Jong

(10) Patent No.: US 7,697,889 B2
(45) Date of Patent: Apr. 13, 2010

(54) APPARATUS AND METHOD FOR OUTPUTTING DATA AFTER RECEIVING DATA FROM FIRST AND SECOND INPUT APPARATUSES

(75) Inventor: Lee Sang Jong, Suwon-si (KR)

(73) Assignee: LG Electronics Inc., Seoul (KR)

( * ) Notice: Subject to any disclaimer, the term of this patent is extended or adjusted under 35 U.S.C. 154(b) by 813 days.

(21) Appl. No.: 11/513,152

(22) Filed: Aug. 31, 2006

(65) Prior Publication Data

US 2007/0207726 A1 Sep. 6, 2007

(30) Foreign Application Priority Data

Mar. 3, 2006 (KR) ..... 10-2006-0020227

(51) Int. Cl.
*H04H 40/00* (2008.01)

(52) U.S. Cl. ..... 455/3.06; 455/3.02; 455/3.03; 455/552.1; 455/566; 455/575.9; 701/36; 701/211

(58) Field of Classification Search ..... 455/3.06, 455/3.02, 3.03, 418, 455, 74, 550.1, 552.1, 455/553.1, 566, 575.9; 701/36, 211, 213; 370/329

See application file for complete search history.

(56) References Cited

U.S. PATENT DOCUMENTS

2005/0261033 A1* 11/2005 Wang ..... 455/566
2006/0025152 A1* 2/2006 Ban ..... 455/456.1
2006/0068699 A1* 3/2006 Lee et al. ..... 455/3.02

* cited by examiner

*Primary Examiner*—Matthew D Anderson
*Assistant Examiner*—Shaima Q Aminzay
(74) *Attorney, Agent, or Firm*—KED & Associates, LLP

(57) ABSTRACT

An apparatus for outputting data may be provided. The apparatus may include a DMB module for receiving a digital multimedia broadcasting (DMB) signal and processing the received DMB signal, a navigation module, and an output unit for outputting data according to at least one of operations of the DMB module and the navigation unit. The apparatus may further include a controller for controlling the DMB module and the navigation module, and controlling a switching operation for switching data to be outputted according to a broadcasting signal received through the DMB module. A method for outputting data may also be provided.

19 Claims, 7 Drawing Sheets

APPARATUS AND METHOD FOR OUTPUTTING DATA AFTER RECEIVING DATA FROM FIRST AND SECOND INPUT APPARATUSES

The present application claims priority from Korean Application No. 20227/2006, filed Mar. 3, 2006, the subject matter of which is incorporated herein by reference.

BACKGROUND

1. Field

Embodiments of the present invention may relate to an apparatus and method for selectively outputting data inputted from a plurality of input units based on a switching operation.

2. Background

If a user sets an output unit to output data inputted from a predetermined input unit, then the output unit may continuously output the data until the user resets the output unit. For example, a user may use an output unit to receive digital multimedia broadcasting (DMB) data from a first input unit (or a first input apparatus) and navigation data from a second input unit (or a second input apparatus) at a same time or at substantially a same time. If the user initially sets the output unit to display video data of the received DMB data and to output audio data of the received navigation data, then the output unit may be continuously operated based on the initial setting even though the DMB data may be interrupted (or is corrupted).

That is, even if the DMB data is not normally inputted, the output unit may display abnormal DMB data while outputting the audio data of the navigation data.

If a terminal includes a DMB function and a navigation function, a user may be allowed to select the DMB function of the terminal for watching a DMB program while the terminal performs the navigation function. The user may also be allowed to select the navigation function while watching the DMB program.

When the user selects both the navigation function and the DMB function for operations at a same time, the terminal may be set to perform the DMB function. In this case, the terminal may output audio data for navigation while outputting the DMB program through a display device and a speaker. More specifically, the terminal may output the audio data for navigation through a speaker while outputting the DMB program through the display device and the speaker. Therefore, the user may be guided to a destination while watching the DMB program.

If the user terminates the DMB function, then the terminal may not only reproduce the audio data for navigation through the speaker but may also display a map for navigation through the display device.

However, such an output unit for DMB and navigation may not display visual information of navigation when the user selects the DMB function. Although the DMB signal may be very weak, the output unit may not display the visual information of navigation.

If the DMB signal is very weak, the DMB module of the output unit may display a predetermined still image and transition into a pause state until a normal signal is received. Although the DMB module displays a predetermined still image and is in the pause state, the output unit may output the audio data of the navigation with only the predetermined still image displayed. That is, the user may be unable to watch the visual information of the navigation.

BRIEF DESCRIPTION OF THE DRAWINGS

The accompanying drawings are included to provide a further understanding of arrangements and embodiments of the present invention and are incorporated in and constitute a part of this application. In the drawings, like reference numerals refer to like elements and wherein.

DETAILED DESCRIPTION

Embodiments of the present invention may relate to an apparatus for outputting data received from different input units (or different input apparatuses) and a switching operation thereof. In the following examples, DMB data and navigation data are used as examples of input data. However, other types of input data are also within the scope of the present invention.

The different input units may include a first input unit (or apparatus) for transmitting or relaying data of digital multimedia broadcasting (DMB) and a second input unit (or apparatus) for transmitting data for navigation. Other types of media and/or data may also be used.

DMB denotes a digital multimedia broadcasting that provides high quality digital data such as CD-quality music, high definition motion pictures and texts. Data of the DMB may be received using a mobile terminal, for example.

Navigation denotes an auto navigation technology that guides a car, a truck, a ship or an airplane, for example, from a current location to a predetermined destination in a predetermined amount of time based on a current location, a traveling path and/or a traveling distance.

A terminal may have both a DMB function for receiving the DMB data and a navigation function for guiding a user to a destination. A user may use such a terminal to watch a predetermined DMB program while receiving an auto navigation service at a same time (or at a substantially same time).

The term DMB may be used throughout this specification because it is a widely used term. Other terms may also be used. DMB may relate to all media related to inputting and/or outputting data. For example, DMB may denote Mobile TV and Media Flow. That is, DMB may denote all media without transmission scheme thereof. Hereinafter, DMB is used as an example of a data receiving/outputting device for convenience. However, other media are also within the scope of embodiments of the present invention.

Figure 1:
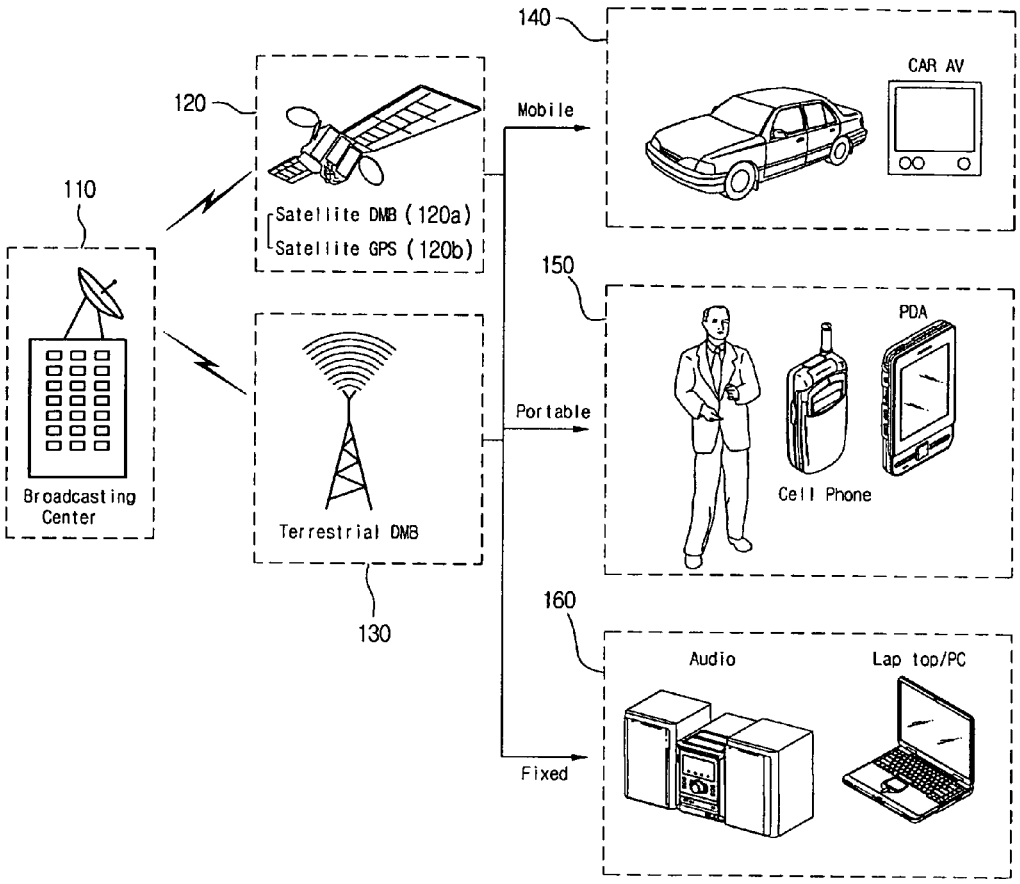
FIG. 1 is a view illustrating various inputting apparatuses according to example embodiments of the present invention.

FIG. 1 is a view illustrating various inputting apparatuses according to example embodiments of the present invention. Other inputting apparatuses and embodiments are also within the scope of the present invention.

More specifically, FIG. 1 shows a system that includes a broadcasting center 110 for transmitting broadcasting data, input apparatuses 120 and 130 (or units) for relaying and transmitting the broadcasting data from the broadcasting center 110 and/or navigation data, and output apparatuses 140, 150 and 160 (or units) for receiving the broadcasting data and/or the navigation data from the input apparatuses 120 and 130 and outputting the received data.

The input apparatuses 120 and 130 may include a satellite and/or a ground repeater. For example, the satellite may be a DMB satellite 120*a* or a GPS satellite 120*b*. The ground repeater may be a terrestrial DMB.

The output apparatuses 140, 150 and 160 may include a mobile terminal mounted at a vehicle (as in apparatus 140), a portable or mobile terminal (as in apparatus 150) and a fixed terminal (as in apparatus 160).

In case of digital multimedia broadcasting (DMB) data (audio, video and text data), the broadcasting center 110 transmits the DMB data, and a first input apparatus such as the DMB satellite 120*a* and/or the terrestrial DMB repeater (as in apparatus 130) relays the DMB data transmitted from the broadcasting center 110. Each of the output apparatuses 140, 150 and 160 may receive the DMB data transmitted from the first input apparatus and output the received DMB data.

In case of navigation data, each of the output apparatuses 140, 150 and 160 may receive navigation data outputted from the input apparatuses (e.g., a plurality of GPS satellites 120*b*) and output the received navigation data.

Figure 2:
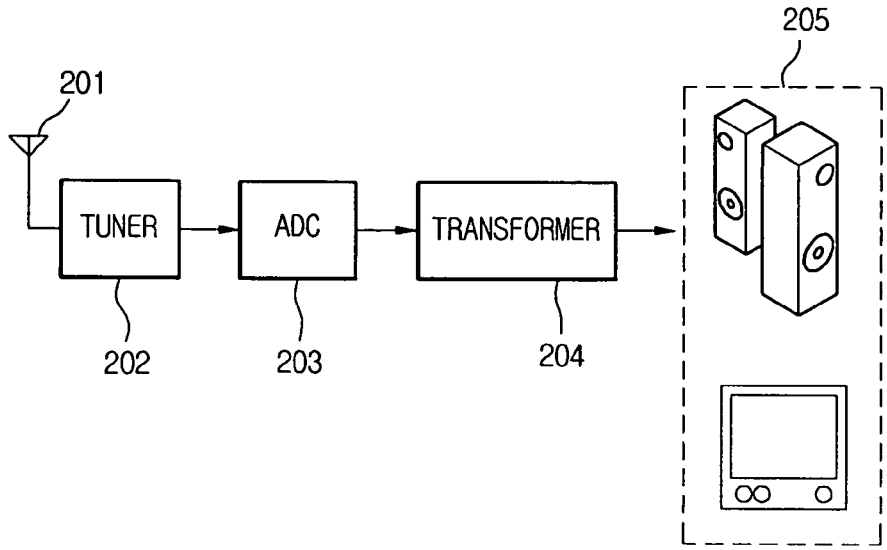
FIG. 2 is a block diagram illustrating an output apparatus for receiving and processing DMB data.

FIG. 2 is a block diagram illustrating an output apparatus for receiving and processing DMB data. FIG. 2 shows the output apparatus receives broadcasting data at an antenna 201. The broadcasting data may have been outputted from the input apparatuses 120 and 130 (of FIG. 1). The broadcasting data may be provided to a tuner 202 through the antenna 201. An analog-to-digital converter (ADC) 203 and a transformer 204 may process the input broadcasting data. The processed broadcasting data is outputted through an output unit 205.

The output apparatus according to example embodiments may be set so as to not output the received broadcasting data inputted from one of the input apparatuses if an intensity, a predetermined state and/or a sharpness of the received broadcasting data inputted to the ADC 203 is smaller than a predetermined value, and/or if the broadcasting data has been continuously inputted from the input apparatus 120 for a predetermined amount of time and fails to satisfy the predetermined value. If one of these circumstances (or other possible circumstance) occurs, then the output unit 205 outputs the video and audio of the navigation data. The intensity, state and/or sharpness of the received broadcasting data correspond to characteristics of the received data.

Even if the intensity, the predetermined state and/or the sharpness of the broadcasting data inputted to the ADC 203 satisfy the predetermined value, the output apparatus may be set to output the video and/or audio for navigation based on information set by a user such as a predetermined amount of time and/or navigation information such as a link period.

As one example, the output unit 205 may output the navigation data only or may output the DMB data and the navigation data at a same time (or at a substantially same time). When the DMB data and the navigation data are simultaneously outputted, the data may be displayed in different sizes such as on a main display area and a sub display area, or displayed on equally divided display areas.

Figure 3:
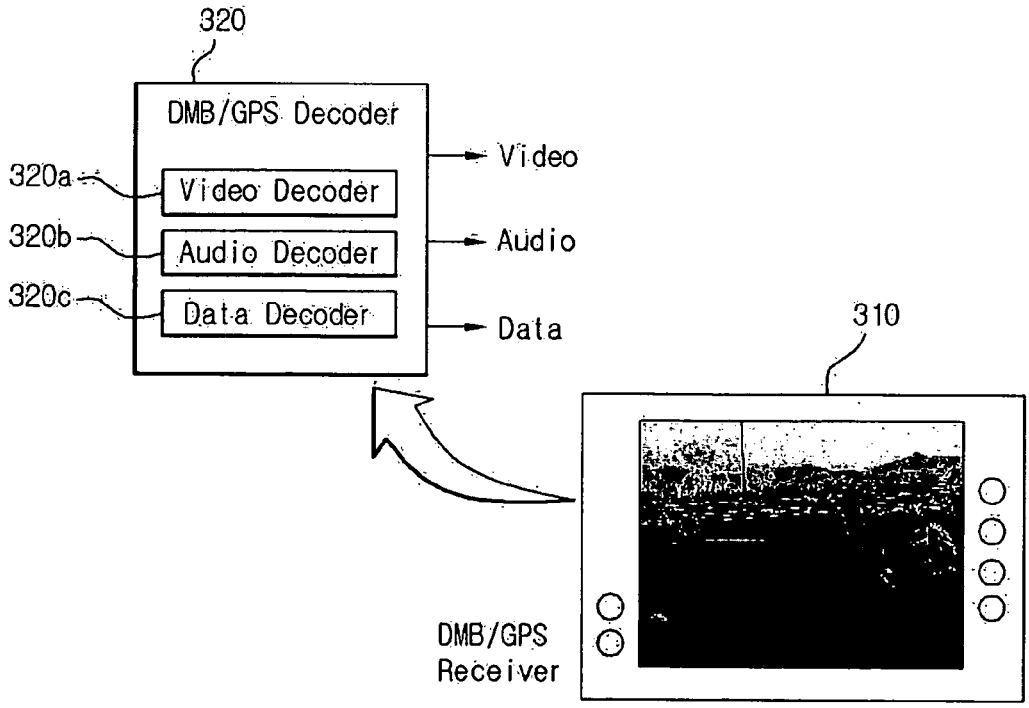
FIG. 3 is a block diagram showing a receiver included in the output apparatuses of FIG. 1.

FIG. 3 is a block diagram showing a receiver included in the output apparatuses (such as the output apparatuses 140, 150 and 160) of FIG. 1. Other configurations may also be provided.

Such a receiver as shown in FIG. 3 may be mounted at a car, for example. The receiver may include a DMB/GPS receiver 310, for example. The receiver may receive DMB data and navigation data from a DMB satellite and a GPS satellite. The receiver may transform the received data at a transformer (or DMB/GPS Decoder) 320 and output data such as audio, video and text data through a display device. The transformer (or DMB/GPS Decoder) 320 may include a video decoder 320*a*, an audio decoder 320*b* and a data decoder 320*c*.

Figure 4:
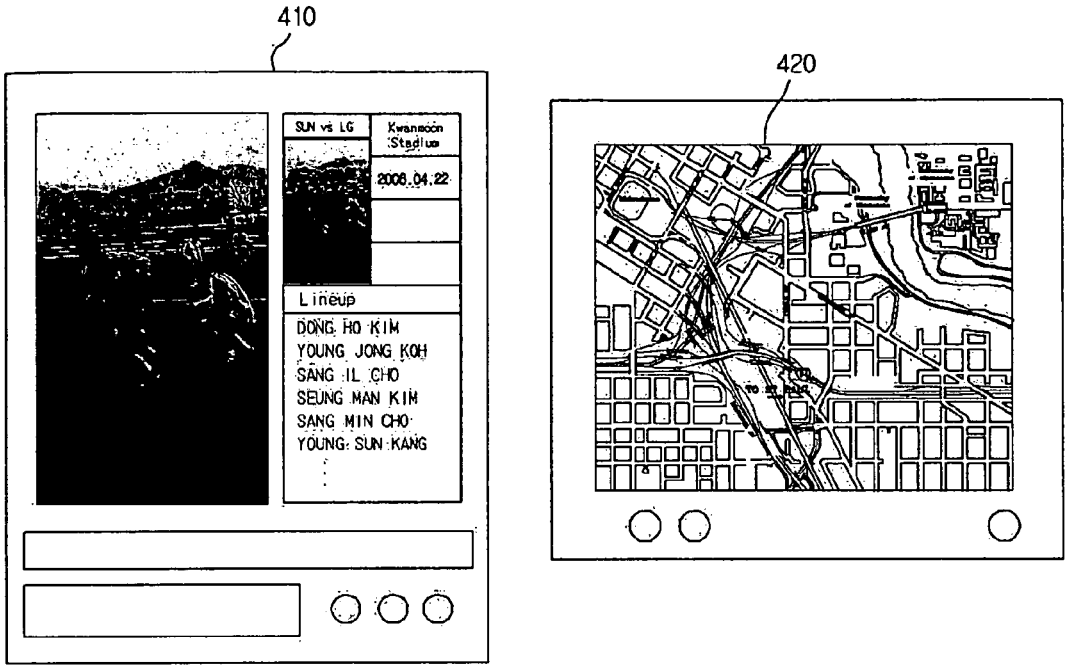
FIG. 4 shows data outputted at an output apparatus according to an example embodiment of the present invention.

FIG. 4 shows data outputted at an output apparatus according to an example embodiment of the present invention. Other embodiments are also within the scope of the present invention. As shown, the output apparatus may output DMB data 410 and navigation data 420.

Figure 5:
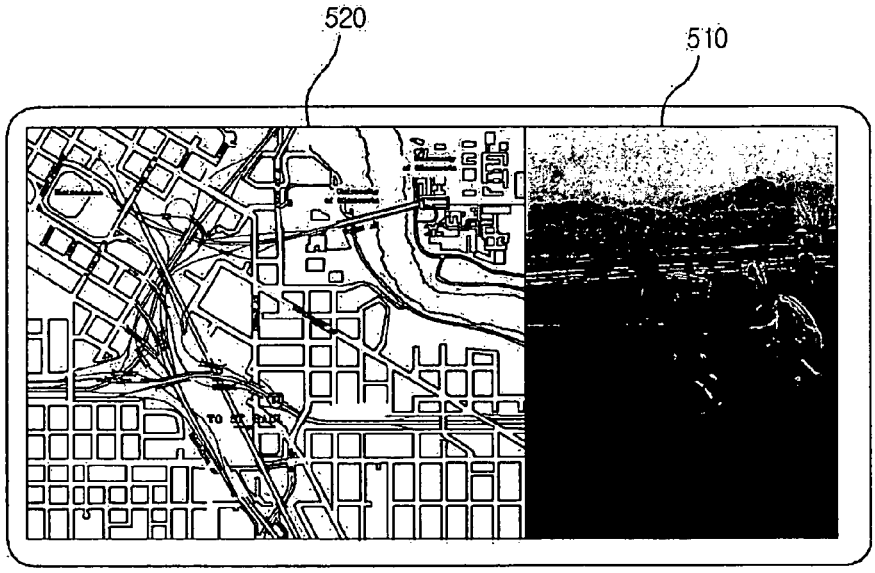
FIG. 5 show data outputted at an output apparatus according to an example embodiment of the present invention.

FIG. 5 show data outputted at an output apparatus according to an example embodiment of the present invention. Other embodiments are also within the scope of the present invention.

As shown in FIG. 5, the output apparatus may output DMB data 510 and navigation data 520 at a same time. The DMB data 510 and the navigation data 520 may be displayed on a main display area and a sub display area, respectively. The DMB data and the navigation data may be displayed in different sizes or in same (or similar) sizes.

Figure 6:
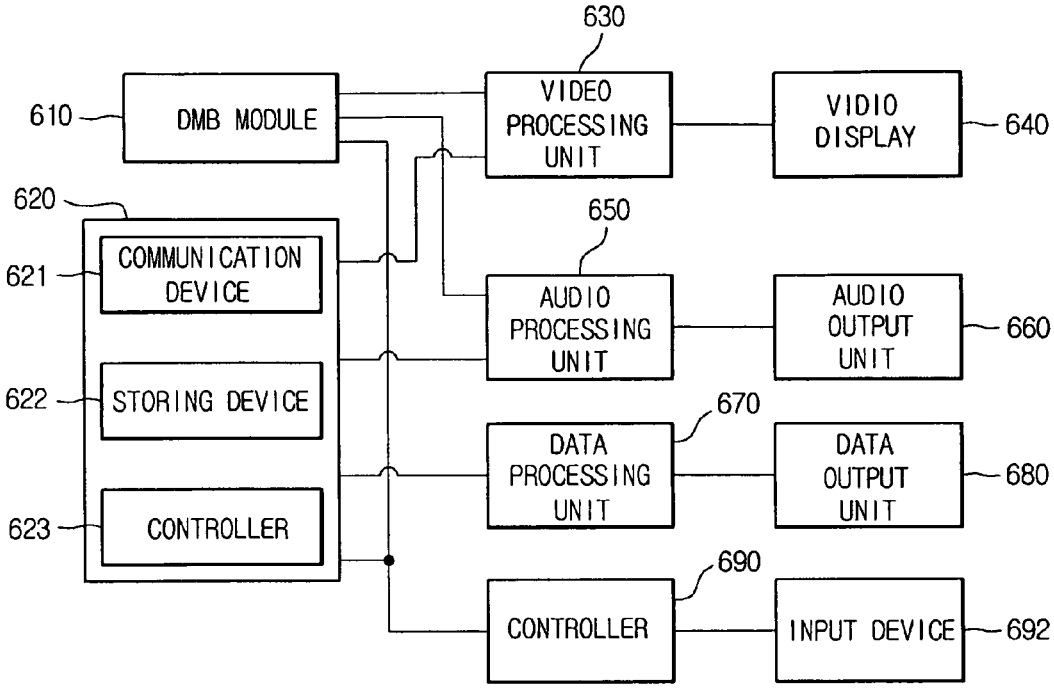
FIG. 6 is a block diagram of a DMB and navigation apparatus according to an example embodiment of the present invention.

FIG. 6 is a block diagram of a DMB and navigation apparatus according to an example embodiment of the present invention. Other embodiments are also within the scope of the present invention. More specifically and as one example, FIG. 6 shows an internal configuration of a DMB/GPS receiver 310.

As shown in FIG. 6, the DMB and navigation apparatus may include a DMB module 610 for receiving DMB data from an input apparatus such as a DMB satellite 120*a* or a terrestrial DMB repeater 130 (both shown in FIG. 1) and processing the received DMB data, and a navigation module 620 for providing an auto navigation function using information received from other input apparatus such as a GPS satellite 120*b* (shown in FIG. 1) and internally stored navigation information. The DMB and navigation apparatus may also include a video processing circuit 630 for processing video data from the DMB module 610 and the navigation module 620, and a video display (or video display unit) 640 for displaying the processed video data.

The DMB and navigation apparatus may further include an audio processing circuit 650 and a data processing circuit 670 for processing audio data and text data, respectively, outputted from the DMB module 610 or the navigation module 620, and an audio output unit 660 and a data output unit 680 for outputting the processed audio/text data from the audio processing circuit 650 and the data processing circuit 670, respectively. An output module of the apparatus may include the video display 640, the audio output unit 660 and the data output unit 680.

The DMB and navigation apparatus may also include a controller 690 for controlling operations of the DMB module 610 and the navigation module 620, and an input device 692 for receiving commands from a user.

The DMB and navigation apparatus may further include a storing device (not shown) for storing programs and information for driving the DMB and navigation apparatus.

The navigation module 620 may include a communication device 621 for receiving information about a current location and traffic condition from the GPS satellite 120*b* (such as shown in FIG. 1) for providing the auto-navigating service and for updating information about a map stored in the receiver, a storing device 622 for storing the updated information from the communication device 621, and a controller 623 for controlling operations of the navigation module 620.

The DMB module 610 receives the DMB data and processes the received DMB data by signal processing and signal transforming operations. Then, the processed DMB data is outputted to the output units 660, 680, 692 and/or the video display 640.

The navigation module 620 provides video data and audio data for guiding a user from a current location to a predetermined destination according to the user's request. Similar to the DMB module 610, the navigation module 620 processes the video data and the audio data through the video processing circuit 630, the audio processing circuit 650 and the data processing circuit 670.

The controller 690 controls the DMB module 610 and the navigation module 620 by performing a switching operation according to a user's selection or according to whether the inputted broadcasting data satisfies a predetermined condition (i.e., whether a characteristic satisfies the condition).

If the DMB module 610 and the navigation module 620 are to be operated at a same time (or a substantially same time), then the controller 690 selects the DMB data or the navigation data to be outputted according to information related to the broadcasting data received from an input apparatus (as shown in FIGS. 1 and 2), and the controller 690 controls the DMB module 610 and the navigation module 620 according to the result of the determination.

As one example, the controller 690 may measure an intensity of the signal of the broadcasting data, or the controller 690 may receive information regarding the intensity. A supplementary unit may also be provided for measuring the intensity of the broadcasting signal.

The broadcasting signal outputted from an input apparatus may be analyzed through the antenna 201, the tuner 202 and the ADC 203 (shown in FIG. 2) to determine whether related DMB data is displayable or is not displayable.

For example, a determination may be made whether the information of the broadcasting signal inputted through the antenna 201 satisfies a predetermined value. The information may be an intensity of the receiving signal, and/or a sharpness of the signal and noise included in the broadcasting signal. Based on this comparison, a determination may be made whether the received broadcasting data is displayable or not.

If the controller 690 determines that the received broadcasting data is not displayable (or is not properly displayable), then the controller 690 may control the video and the audio data for the auto navigation service to be outputted while checking (i.e., monitoring) the DMB broadcasting signal on a regular basis or a continuous basis.

The power of the DMB module 610 may be turned OFF. In this case, the broadcasting signal may be checked by turning the DMB module 610 ON or OFF on a regular basis, for example, or by continuously turning ON the DMB module 610. The DMB and navigation apparatus may be controlled according to the result (or results) of checking (i.e., monitoring) the broadcasting signal.

The input device 692 may receive a command inputted from the user. The input device 692 may receive the command through buttons of the DMB and navigation apparatus, a remote controller and/or a voice input, for example.

Figure 7:
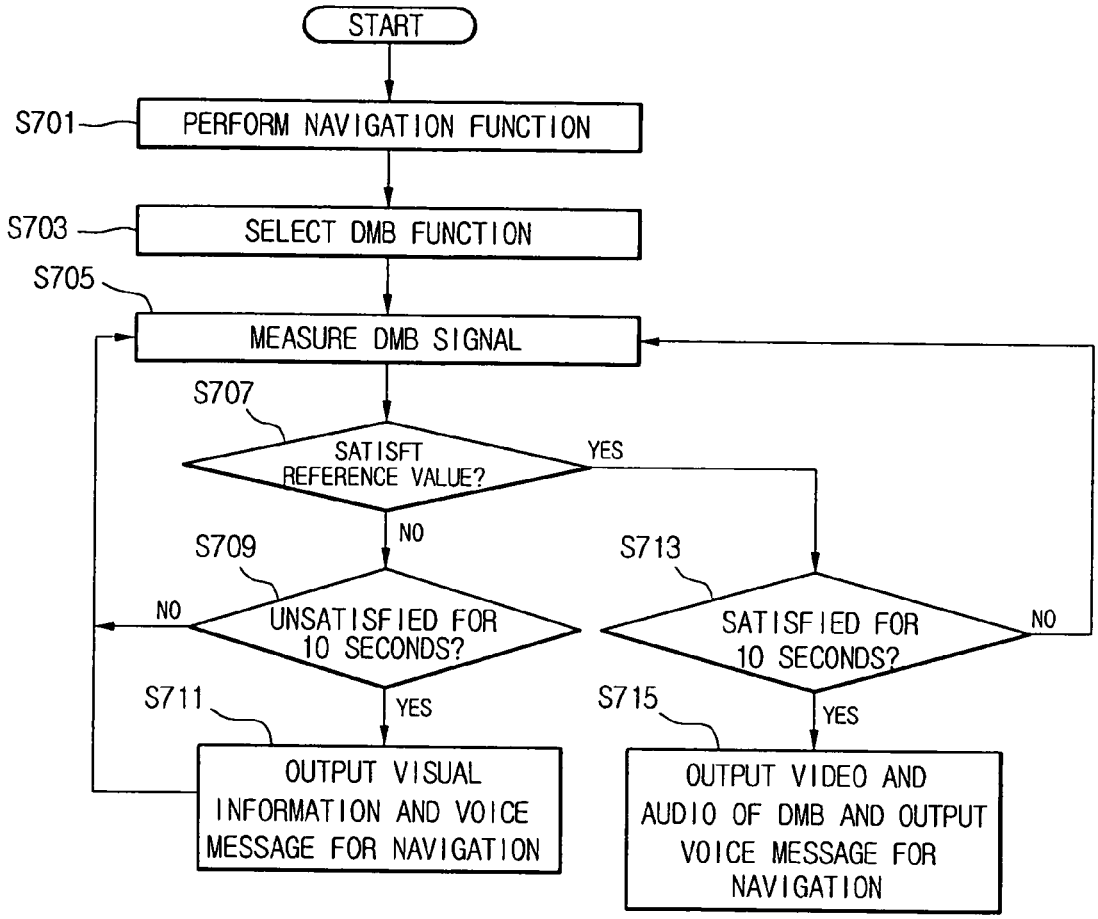
FIG. 7 is a flowchart of a method of driving a DMB and navigation apparatus according to an example embodiment of the present invention.

FIG. 7 is a flowchart of a method of driving a DMB and navigation apparatus according to an example embodiment of the present invention. Other operations, orders of operations and embodiments are also within the scope of the present invention.

With reference to FIGS. 6 and 7, when the DMB and navigation apparatus according to the present embodiment is turned ON by a user and the user activates the navigation function, the controller 690 controls the navigation module 620 to perform the navigation function by receiving information about a current location and a destination from the input device 692 in operation S701.

Since the user does not activate the DMB function in the operation S701, the video display 640 and the data output unit 680 display map information and data information for the navigation function, and the audio output unit 660 outputs voice messages relating to driving directions.

If a user selects the DMB function while performing the navigation function in operation S703, the controller 690 activates the DMB module 610. The DMB signal received at the DMB module 610 may be measured in operation S705. For example, the intensity of the DMB signal may be measured in operation S705.

The method of measuring the DMB signal may include measuring a broadcasting signal in a broadcasting terminal, or the method described above with respect to FIG. 2.

For example, a determination may be made whether an amplitude of the broadcasting frequency, a frequency sharpness and/or inputted noise satisfy a predetermined reference value (such as are greater or less than the predetermined reference value).

The controller 690 may determine whether the measured DMB signal, for example, the intensity of the broadcasting signal, satisfies (i.e., greater than) the predetermined reference value in operation S707.

The reference value may denote a general broadcasting signal that provides normal video and audio data, and if the DMB signal is measured to be lower than the reference value, then the controller 690 may determine that the received DMB signal is not displayable.

For example, if the measured broadcasting signal is weaker than the predetermined reference broadcasting signal, such a broadcasting signal has no DMB information to be displayed because the DMB signal is a digital signal.

If the received DMB signal is determined to be a weaker signal than the predetermined reference value in operation S707, a determination may be made whether the weak DMB broadcasting signal has been continuously inputted for a predetermined amount of time or not in operation S709. As one example, the predetermined amount of time may be 10 seconds. Other amounts of time may also be used.

That is, a determination may be made whether the DMB signal is instantly weakened or the DMB signal is continuously weakened for a predetermined amount of time due to an unknown reason. The DMB signal may be analyzed to determine whether the received DMB signal is displayable or is not displayable.

If the received DMB signal has been continuously measured as a weak signal for a predetermined amount of time, then the controller 690 determines that the received DMB signal can not properly provide DMB data such as video, audio and text data to be outputted. Then, the controller 690 controls the video data and the audio data for navigation to be displayed and outputted in operation S711.

The controller 690 may temporarily turn OFF the DMB module 610 in order to save power. In this case, the controller 690 may turn the DMB module 610 back ON at a regular interval (or after a prescribed amount of time) to measure a DMB signal received at the DMB module 610.

Meanwhile, the controller 690 may measure the received DMB signal without turning OFF the DMB module 610 and may control the received DMB signal to be displayed according to the measured result.

In disadvantageous arrangements, a predetermined still image may be displayed while receiving an abnormal DMB signal. However, the method of driving the DMB and navigation apparatus according to an example embodiment of the present invention may display map information and output voice messages for the navigation to guide a user to a predetermined destination while receiving the abnormal DMB signal.

Although the DMB signal satisfies the predetermined reference value in the operation S717, the controller 690 may continuously check the received DMB signal at the DMB module 610. If the DMB signal satisfies the reference value and is continuously received for a predetermined amount of time in operation S713, then the controller 690 determines that the normal DMB function can be performed. The controller 690 may control the video display 640, the audio output unit 660 and the data output unit 680 to output the received DMB signal and to output only the audio data for the navigation function in operation S715.

The method of driving the DMB and navigation apparatus according to an embodiment of the present invention may be applicable although an order of performing the operations S701 and S703 may be reversed.

That is, if a user inputs a command to activate the navigation function while watching a DMB program, then a DMB program and map information for guiding the user to the destination may be displayed by performing operations 705 through S715.

Use of the DMB and navigation apparatus according to example embodiments of the present invention will now be described. Other uses and examples are also within the scope of the present invention.

If a driver (or other user) of a car turns on the DMB and navigation apparatus, the DMB and navigation apparatus may display map information to guide the user from a current location to a predetermined destination and the DMB and navigation apparatus may output voice messages through a speaker.

While outputting such navigation data, if the driver (or other user) wants to watch a DMB program, the driver (or other user) may activate the DMB function through the input device of the receiver as shown in FIG. 3.

Then, the DMB and navigation apparatus drives the DMB module while outputting the navigation data. After driving the DMB module, the DMB and navigation apparatus may measure the received DMB signal and compare the measured value to a predetermined reference value.

The DMB and navigation apparatus may determine that the received DMB signal can be normally displayed if the received signal satisfies (i.e., is greater than) the predetermined reference broadcasting signal (or value). If the current received DMB signal satisfies the reference value, then the DMB signal is displayed and outputted through the video display device and the speaker, and only the voice message of the navigation function is outputted through the speaker.

That is, the DMB and navigation apparatus may output a voice message through the speaker for navigation such as please, turn left at the next intersection while displaying the DMB signal on the video display.

While displaying the DMB data and outputting the voice message for the navigation, the DMB and navigation apparatus may regularly (or irregularly) measure the DMB signal and compare the measured value to the reference value.

If the received DMB signal does not satisfy the predetermined reference value due to environmental factors (or other factors), then the DMB and navigation apparatus determines whether such an abnormal state continues over a predetermined duration of time.

The predetermined duration of time may be 10 seconds, for example. In this example, if the DMB and navigation apparatus receives the unsatisfied DMB signal for 10 seconds, then the DMB and navigation apparatus may determine that the received DMB signal can not be displayed.

If the unsatisfied DMB signal has been received for 10 seconds, then the DMB and navigation apparatus determines that the received DMB signal cannot be displayed. Then, the DMB and navigation apparatus displays visual information of the navigation function and outputs voice messages for the navigation function through the speaker.

It is possible to output only the audio data of the DMB signal through the speaker.

While performing the navigation function, the DMB and navigation apparatus may continuously measure the DMB signal. If the DMB and navigation apparatus receives the satisfied DMB signal for a predetermined amount of time, then the DMB and navigation apparatus may output the DMB signal through the video display device and the speaker and output only the voice message of the auto-navigation function through the speaker.

Figure 8:
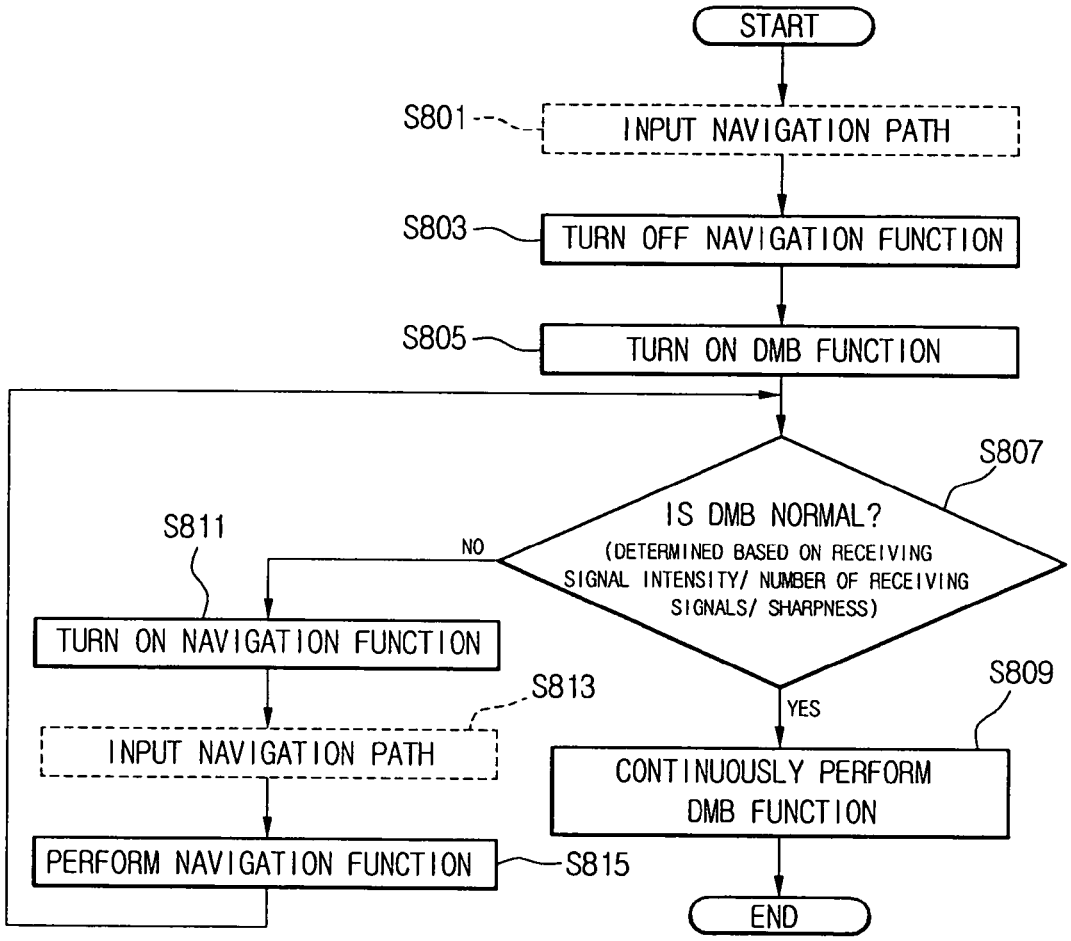
FIG. 8 is a flowchart of a method of driving a DMB and navigation apparatus according to an example embodiment of the present invention.

FIG. 8 is a flowchart of a method of driving a DMB and navigation apparatus according to an example embodiment of the present invention. Other operations, orders of operations and embodiments are also within the scope of the present invention.

In the DMB and navigation apparatus according to the example embodiment of FIG. 8, a user may input a path of navigation through an input device and the inputted path of navigation is stored in operation S801. The input of the navigation path need not be performed in advance.

The navigation function may be turned OFF and the DMB function may be turned ON in operations S803 and S805, respectively.

The apparatus may determine whether the DMB function is normally performed or not, for example, by checking the intensity of the broadcasting signal, the number of the received signals and/or the sharpness in operation S807.

If the broadcasting signal satisfies the predetermined values, then the DMB function is continuously performed in operation S809.

If the broadcasting signal does not satisfy the predetermined values, then the navigation function is turned ON in operations S811 and S815.

The navigation path may be inputted through an input device in operation S813.

Figure 9:
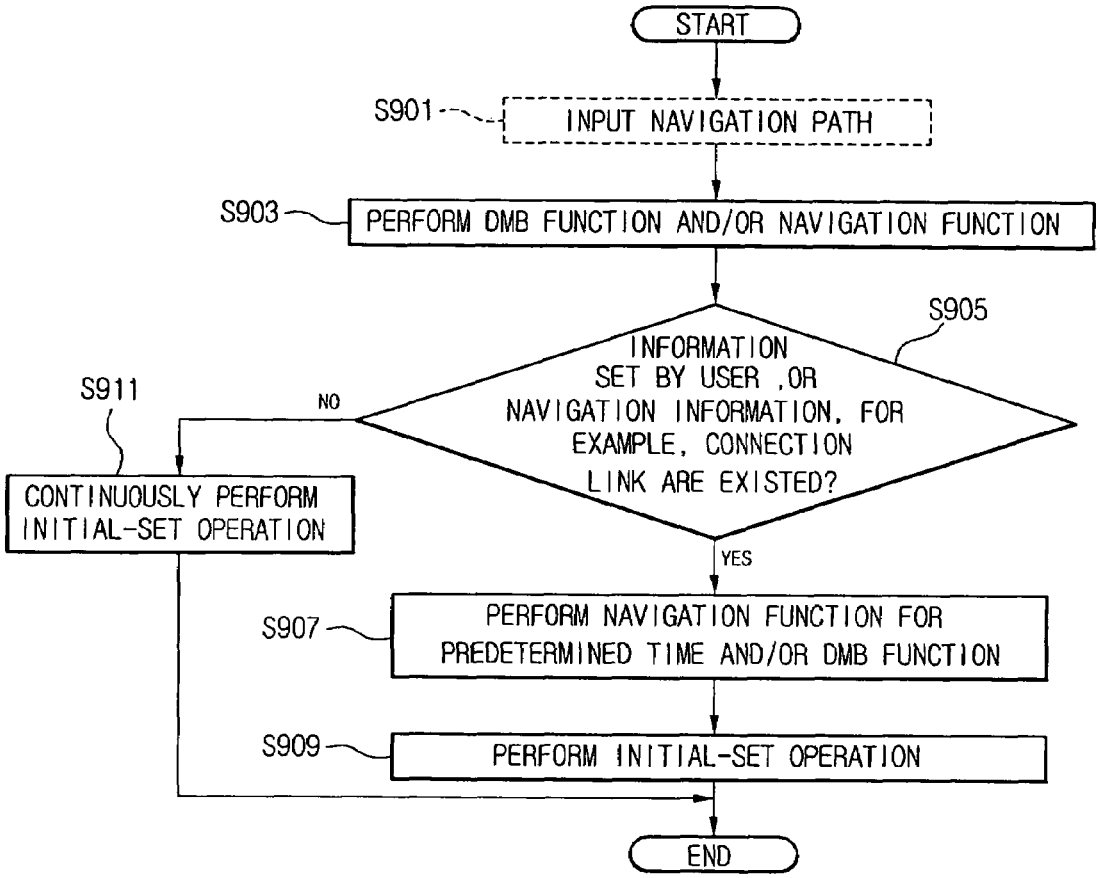
FIG. 9 is a flowchart of a method of driving a DMB and navigation apparatus according to an example embodiment of the present invention.

FIG. 9 is a flowchart of a method of driving a DMB and navigation apparatus according to an example embodiment of the present invention. Other operations, orders of operations and embodiments are also within the scope of the present invention.

In the DMB and navigation apparatus according to the example embodiment of FIG. 9, a user inputs a path of navigation through an input device and the inputted path of navigation is stored in operation S901. The input of the navigation path need not be performed in advance.

At least one of the navigation function and the DMB function is turned ON in operation S903.

For example, the video, the audio and the text of the DMB data are outputted and only the audio data for the navigation is outputted.

If a user wants to output predetermined information or link information for navigation while the DMB data is outputted, then the displayed DMB data is switched to the navigation information without regard to whether the DMB signal is normally displayed or not in operation S905.

The link information may be recognized using GPS information from a satellite and map information stored in a system. In this case, the navigation function operates for a predetermined amount of time in operation S907.

The navigation function only may be performed, or the navigation function and the DMB function may be simultaneously performed. For example, the data of the navigation function and the data for the DMB function may be displayed in a main display area and a sub display area, respectively, or in equally-divided display areas in operation S907.

After operating for the predetermined amount of time, the initially set operation may be re-performed in operation S909.

If there is no information set by a user and/or navigation information in the operation S905, then the initially set operation may be continuously performed in operation S911.

As described above, although the DMB and navigation apparatus performs the DMB function and the navigation function at a same time, the DMB and navigation apparatus may display visual data for the navigation function and output voice messages for the navigation function if the DMB signal does not satisfy the predetermined reference condition or the DMB is in a particular state. The DMB and navigation apparatus may display the DMB signal while performing the navigation function.

Embodiments of the present invention may be directed to an apparatus and method for outputting data that substantially obviates one or more problems due to limitations and disadvantages of disadvantageous arrangements.

Embodiments of the present invention may provide an apparatus for outputting data inputted from a second input unit (or apparatus) through switching by determining whether data inputted from a first input unit (or apparatus), which is initially set to output the data by a user, is normal or not using at least one of receiving signal intensity information, receiving signal sharpness information and/or duration for receiving a receiving signal.

Embodiments of the present invention may provide an apparatus for driving a unit of receiving data inputted from a second input unit (or apparatus) by determining whether data inputted from a first input unit (or apparatus), which is initially set to output data by a user, is normal or not using at least one of receiving signal intensity information, receiving signal sharpness information and duration for receiving a receiving signal.

Embodiments of the present invention may provide an apparatus for outputting data inputted from a second input unit (or apparatus) based on one of information set by a user and information stored in a second input unit (or apparatus) or stored in a navigation unit although data inputted from a first input unit (or apparatus), which is initially set to output data by a user, is normal.

Embodiments of the present invention may provide a DMB and navigation apparatus and a driving method for outputting visual information and voice messages outputted from a navigation unit if an intensity of a DMB signal is weaker than a predetermined value, or according to predetermined information or navigation information while simultaneously (or substantially simultaneously) outputting the DMB data inputted from a first input unit (or apparatus) and the navigation data inputted from a second input unit (or apparatus).

Embodiments of the present invention may provide an apparatus for outputting data that includes a DMB module for receiving a digital multimedia broadcasting (DMB) signal and processing the received DMB signal, a navigation unit, an output unit for outputting data according to at least one of the operations of the DMB module and the navigation unit, and a controlling unit for controlling the DMB module and the navigation unit, and controlling a switching operation for switching data to be outputted according to a broadcasting signal received through the DMB module.

Embodiments of the present invention may also provide a method of outputting data inputted from a plurality of input units. The method may include outputting data of a first input unit (or apparatus), determining whether the data of the first input unit is normally inputted or not, and outputting data of a second input unit (or apparatus) based on the determination result.

Embodiments of the present invention may further provide a method of outputting data inputted from a plurality of input units. This may include outputting data of a first input unit (or apparatus), and outputting data of a second input unit (or apparatus) through switching using at least one of information set by a user and information related to the second input unit.

The DMB and navigation apparatus according to embodiments of the present invention may output visual information and voice messages for navigation based on predetermined information if a DMB signal does not satisfy a predetermined reference value or if the DMB signal satisfies the predetermined reference value while performing a DMB function and a navigation function at a same time (or at substantially a same time).

Additional features and embodiments of the present invention will become apparent to those having ordinary skill in the art. Objectives and other advantages of embodiments of the present invention may be realized and attained by the structure particularly pointed out in the written description and claims hereof as well as the appended drawings.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments of the present invention have been described with reference to a number of illustrative embodiments thereof, it should be understood that numerous other modifications and embodiments can be devised by those skilled in the art that will fall within the spirit and scope of the principles of this invention. More particularly, reasonable variations and modifications are possible in the component parts and/or arrangements of the subject combination arrangement within the scope of the foregoing disclosure, the drawings and the appended claims without departing from the spirit of the invention. In addition to variations and modifications in the component parts and/or arrangements, alternative uses will also be apparent to those skilled in the art.

It will be apparent to those skilled in the art that various modifications and variations can be made to embodiments of the present invention. Thus, it is intended that embodiments of the present invention cover the modifications and variations provided they come within the scope of the appended claims and their equivalents.

What is claimed is:

1. A method of outputting data from an output apparatus comprising:

receiving broadcast data from a first input apparatus;

receiving navigation data from a second input apparatus;

determining whether a characteristic of the broadcast data received from the first input apparatus satisfies a reference value; and outputting at least one of a data related to the broadcast data from the first input apparatus or the navigation data received from the second input apparatus based on the determination, wherein the outputting includes outputting navigation audio data from a speaker based on the navigation data received from the second input apparatus when the determining determines that the broadcast data received from the first input apparatus does not satisfy the reference value.

2. The method according to claim 1, wherein the characteristic comprises a receiving signal intensity, a receiving signal sharpness or a duration of a receiving signal based on the broadcast data received from the first input apparatus.

3. The method according to claim 1, wherein the outputting further includes displaying broadcast data received from the first input apparatus when the determining determines that the broadcast data received from the first input apparatus satisfies the reference value.

4. The method according to claim 3, further comprising determining whether the received broadcast data satisfies the reference value while displaying the broadcast data.

5. The method according to claim 1, wherein the outputting further includes displaying the broadcasting data and the navigation data on a display device at a same time when the determining determines that the broadcast data received from the first input apparatus satisfies the reference value.

6. The method according to claim 1, wherein the outputting includes displaying map information and outputting a voice message for navigation in response to receiving an abnormal signal from the first input apparatus.

7. The method according to claim 6, wherein the displayed map information is a still image.

8. The method according to claim 1, wherein the outputting includes displaying only the navigation data when the determining determines that the broadcast data received from the first input apparatus does not satisfy the reference value.

9. The method according to claim 1, further comprising turning power off to the first input apparatus when the determining determines that the broadcast data received from the first input apparatus does not satisfy the reference value.

10. A method comprising:

receiving broadcast data at a broadcast input module of an apparatus;

receiving navigation data at a navigation input module of the apparatus;

determining, at the apparatus, whether a received broadcast signal received from the broadcast input module is greater than a reference value;

outputting the broadcast data received from the broadcast input module when the determining determines that the received broadcast signal is greater than the reference value; and outputting the navigation data received from the navigation input module, wherein outputting the broadcast data and outputting the navigation data includes:

outputting the broadcast data and the navigation data from a display device at a same time when the determining determines that the received broadcast signal is greater than the reference value, and outputting at least one of a data related to the broadcast data from the broadcast input module, the navigation data received from the navigation input module or navigation audio data from a speaker based on the navigation data received from the navigation input module when the received broadcast signal is less than the reference value.

11. The method according to claim 10, wherein the broadcast data are displayed on a first display area of the display device and the navigation data are displayed on a second display area of the display device.

12. The method according to claim 10, wherein the navigation data is output when a signal intensity or signal sharpness of the broadcast data received from the broadcast input module does not satisfy the reference value.

13. The method according to claim 10, wherein the navigation data is output when a signal intensity or signal sharpness of the broadcast data received from the broadcast input module does not satisfy the reference value over a prescribed amount of time.

14. The method according to claim 10, further comprising turning power off to the broadcast input module when the broadcast signal received from the broadcast input module is less than the reference value.

15. The method according to claim 10, further comprising determining whether the received broadcast signal is greater than the reference value while displaying the broadcast data.

16. An apparatus for outputting data comprising:

a digital multimedia broadcasting (DMB) module to receive a DMB signal;

a navigation module to provide navigation information;

an output module to output data based on operations of the DMB module and the navigation module; and a controller to control the output module to output data based on a broadcasting signal received by the DMB module, wherein the controller outputs broadcast data and navigation audio data from the output module at a same time when a characteristic of the received DMB signal is greater than a reference value, and the controller outputs at least one of a data related to the broadcast data from the DMB module, the navigation data received from the navigation module or navigation audio data from a speaker based on the navigation data received from the navigation module when the received DMB signal is less than the reference value.

17. The apparatus according to claim 16, wherein the controller controls the output module to output data based on an intensity of the DMB signal received through the DMB module or a sharpness of the DMB signal.

18. The apparatus according to claim 17, wherein the controller controls the output module to output visual information and a voice message from the navigation module when the DMB module receives the DMB signal having the intensity that does not satisfy a reference value for a predetermined amount of time.

19. The apparatus according to claim 18, wherein the controller controls the output module to output video data and audio data from the DMB module and to output a voice message from the navigation module when the DMB module receives the DMB signal having the intensity that satisfies the reference value for the predetermined amount of time.

* * * * *